United States Patent [19]

Masuda et al.

[11] Patent Number: 4,536,264

[45] Date of Patent: Aug. 20, 1985

[54] METHOD FOR ELECTROLYTIC TREATMENT

[75] Inventors: Takanori Masuda; Tsutomu Kakei; Teruo Miyashita; Akira Morita, all of Shizuoka; Masahiro Takahashi, Tokyo, all of Japan

[73] Assignees: Fuji Photo Film Co., Ltd.; Nippon Light Metal Company, Ltd., both of Japan

[21] Appl. No.: 652,996

[22] Filed: Sep. 21, 1984

[30] Foreign Application Priority Data

Sep. 21, 1983 [JP] Japan ..... 58-173148

[51] Int. Cl.[3] ..... C25F 3/02; C25F 3/04; C25F 7/00

[52] U.S. Cl. ..... 204/129.43; 204/211; 204/231; 204/DIG. 9

[58] Field of Search ..... 204/206, 211, 231, DIG. 9, 204/129.43

[56] References Cited

U.S. PATENT DOCUMENTS

| | | | |
|---|---|---|---|
| 2,901,412 | 8/1959 | Mostovych | 204/211 |
| 2,951,025 | 8/1960 | Mostovych | 204/211 |
| 4,087,341 | 5/1978 | Takahashi | 204/129.43 |
| 4,214,961 | 7/1980 | Anthony | 204/211 |
| 4,294,672 | 10/1981 | Ohba | 204/DIG. 9 |
| 4,297,184 | 10/1981 | Dyer | 204/DIG. 9 |
| 4,315,806 | 2/1982 | Arora | 204/129.43 |

*Primary Examiner*—Thomas Tufariello

*Attorney, Agent, or Firm*—Sughrue, Mion, Zinn, Macpeak and Seas

[57] ABSTRACT

A method for continuously electrolytically processing a metal web in which the consumption rate of graphite electrodes is remarkably reduced. Auxiliary anodes made of a nonreactive material are provided separately from the graphite electrodes. One half of a symmetrical waveform is applied directly between the graphite electrodes, while for the other half of the waveform, a portion of the current is distributed through the auxiliary anodes. In this manner, the magnitude of the current contributing to a cathode reaction on the surfaces of the graphite electrodes is made larger than the magnitude of the current contributing to an anode reaction on the surfaces of the graphite electrodes, thereby reducing the consumption rate of the graphite electrodes.

6 Claims, 5 Drawing Figures

| | | |
|---|---|---|
| (1) | DIRECT CURRENT WAVEFORM |   |
| (2) | SYMMETRIC ALTERNATE CURRENT WAVEFORM |   |
| (3) | ASYMMETRIC ALTERNATE CURRENT WAVEFORM |   |
| (4) | ASYMMETRIC ALTERNATE CURRENT WAVEFORM |   |
| (5) | ASYMMETRIC ALTERNATE CURRENT WAVEFORM (SQUARE - WAVE ) |   |
| (6) | ASYMMETRIC ALTERNATE CURRENT WAVEFORM (SQUARE - WAVE ) |   |

METHOD FOR ELECTROLYTIC TREATMENT

BACKGROUND OF THE INVENTION

The present invention relates to a method for electrolytic treatment on the surface of metal web in which the stability of the electrodes is improved.

Examples of a method of applying an electrolytic treatment to the surface of a metal member made of aluminum, iron or the like are the plating method, the electrolytic roughening method, the electrolytic etching method, the anodic oxidation method, the electrolytic coloring method, and the electrolytic satin finishing method, all which have been extensively employed in the art. D.C. sources, power mains A.C. sources, superposed-waveform current sources, and thyristor-controlled special-waveform or square-wave A.C. sources have been employed with these methods in order to meet requirements of quality of the electrolytic treatment or to improve the reaction efficiency. For instance, U.S. Pat. No. 4,087,341 discloses a process in which an A.C. is applied in the electrolytic treatment of an aluminum plate with the voltage applied to the anode electrode being higher than that applied to the cathode electrode, whereby an aluminum substrates for lithographic printing whose surface is electrograined satisfactorily is obtained. When using a regulated A.C., it is essential to employ electrodes which are highly stable. In general, platinum, tantalum, titanium, iron, lead and graphite are employed as electrode materials. Graphite electrodes are widely employed because they are chemically relatively stable and are of low cost.

FIG. 1 shows an example of a conventional continuous electrolytic treatment system for metal webs which utilizes graphite electrodes. In this system, a metal web 1 is introduced into an electrolytic cell 4 while being guided by a guide roll 2, and is conveyed horizontally through the cell while being supported by a roll 3. Finally, the web 1 is moved out of the cell passing around a guide roll 5. The electrolytic cell 4 is divided by an insulator 6 into two chambers in which graphite electrodes are arranged on both sides of the metal web 1. A supply of electrolytic solution 28 is stored in a tank 9. A pump 10 supplies the electrolytic solution 28 to electrolytic solution supplying pipes 11 and 12 which debouch into the electrolytic cell 4. The electrolytic solution thus supplied covers the graphite electrodes 7 and 8 and the metal web and then returns to the tank 9 through a discharging pipe 13. A power source 14 connected to the graphite electrodes 7 and 8 applies a voltage thereto. An electrolytic treatment can be continuously applied to the metal web 1 with this system.

The power source 14 may produce (1) direct current, (2) symmetric alternate current waveform, (3) and (4) asymmetric alternate current waveform, and (5) and (6) asymmetric square-wave alternate current waveform as shown in FIG. 2. In general, in such an A.C. waveform, the average value of the forward current $I_n$ is not equal to the average value of the reverse current $I_r$.

A graphite electrode is considerably stable when used as a cathode electrode. However, when a graphite electrode is used as an anode electrode, it is consumed in the electrolytic solution, forming $CO_2$ by anode oxidation and, at the same time, it decays due to erosion of the graphite interlayers, which occurs at a rate depending on electrolytic conditions. When decay occurs, the current distribution in the electrode changes so that the electrolytic treatment becomes nonuniform. Therefore, the occurrence of such a phenomenon should be avoided in a case where the electrolytic treatment must be done with high accuracy. Accordingly, it is necessary to replace the electrodes periodically. This requirement is a drawback for mass production, and is one of the factors which lowers productivity.

An object of the invention is to provide an electrolytic treatment method in which, based on the properties of graphite, the electrodes are maintained sufficiently stable even in an electrolytic treatment using an asymmetric waveform A.C.

SUMMARY OF THE INVENTION

Taking advantage of these findings, the invention provides an electrolytic processing method in which the consumption rate of graphite electrodes is greatly reduced, even in the case where a symmetric waveform current is used.

More specifically, according to the present invention, a method is provided for continuously electrolytically processing a metal web using graphite electrodes and a symmetric alternating current waveform characterized in that a part of a half cycle of the current is bypassed into a separately provided auxiliary anode through a resistor and a diode so that the magnitude of the current contributing to a cathode reaction is made larger than the magnitude of the current contributing to an anode reaction on the surfaces of the graphite electrode.

DESCRIPTION OF THE PREFERRED EMBODIMENTS

Figure 1:
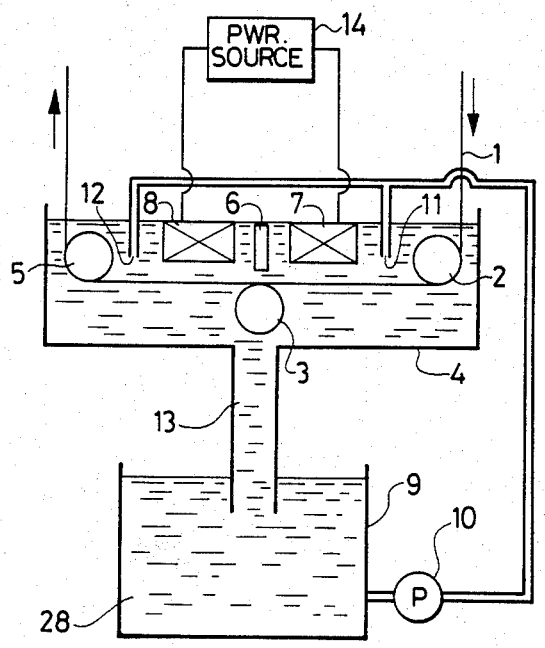
FIG. 1 PRIOR ART
FIG. 1 is an explanatory schematic diagram showing an example of a conventional continuous electrolytic processing apparatus.
Figure 3:
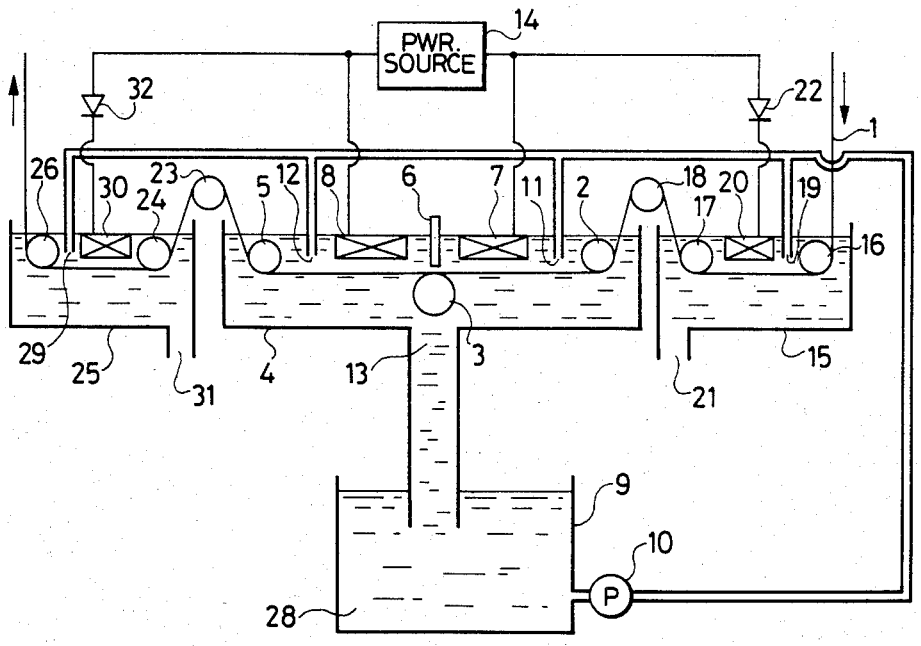
FIGS. 3, 4 and 5 are explanatory schematic diagrams showing various embodiments of a continuous electrolytic processing apparatus employing the method of the present invention.

FIG. 3 is an explanatory diagram showing the arrangement of a metal web electrolytic processing system employing the method according to the present invention. In this method, symmetrical waveforms as illustrated by waveforms (2) to (5) in FIG. 2 may be employed.

The metal web 1 is directed into an auxiliary electrolytic cell 15 by a guide roll 16, and then directed by pass rolls 17 and 18 to the electrolytic cell 4 by the guide roll 2. The metal web 1 is transported horizontally using the support roll 3 and then conveyed out of the cell 4 by the roll 5. The metal web 1 is next passed to another auxiliary electrolytic cell 25 through pass rolls 23 and 24, and then conveyed out of the cell 25 by a guide roll 26. Insoluble anodes 20 and 30 are provided as auxiliary electrodes in the auxiliary electrolytic cells 15 and 25, respectively. Platinum, lead or the like is utilized to form the insoluble anodes 20 and 30. The electrolytic liquid 28 is pumped to electrolytic cells 15 and 25 by a pump 10, fillng the space around the insoluble anodes 20 and 30 and metal web 1. The electrolytic liquid is returned to the circulating tank 9 through outlets 21 and 31.

The electrolytic cell 4 is divided into two chambers by an insulator 6, and graphite electrodes 7 and 8 are arranged adjacent the metal web 1. The electrolytic liquid 28 is pumped to the electrolytic liquid supplying inlets 11 and 12 in the electrolytic cell 4, filling the space around the graphite electrodes 7 and 8 and the metal web 1 facing the electrodes, and then returned to the circulating tank 9 through a discharging outlet 13. A heat exchanger and a filter (not shown) may be provided in a part of the circulating system to control the temperature of the electrolytic liquid 28 and to remove impurities.

Figure 2:
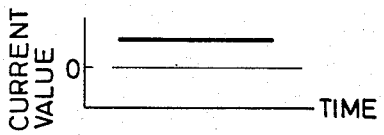
FIG. 2 is a diagram showing various current waveforms.
Figure 2:
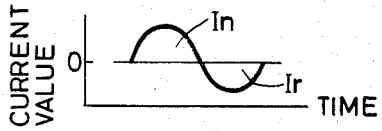
Figure 2:
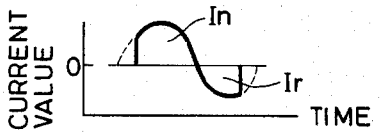
Figure 2:
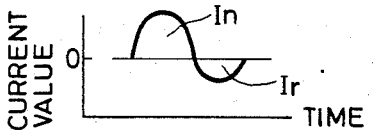
Figure 2:
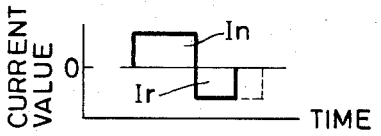
Figure 2:
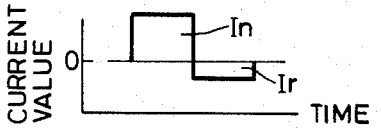

A symmetrical alternating waveform current of the type of waveforms (2) to (5) of FIG. 2 is applied from a power source 14. In this case $I_n=I_r$, where $I_n$ represents the positive current amplitude and $I_r$ represents the negative current amplitude. One terminal of the power source 14 is connected to the graphite electrode 7 and the insoluble anode 20 in the auxiliary electrolytic cell 15 through a thyristor or diode 22. The other terminal of the power source 14 is connected to the graphite electrode 8 and the insoluble anode 30 in the auxiliary electrolytic cell 25 through a thyristor or diode 32.

During the forward cycle of the power source 14, the current $I_n$ is distributed to the graphite electrode 7 and the insoluble anode 20, causing an anode reaction on the surface of each of these electrodes, and supplied to the metal web 1 through the electrolytic liquid 28. At the same time, the metal web 1 opposed to these electrodes is subjected to cathode reaction processing. The current $I_n$ flows through the metal web 1 by electronic conduction and then to the graphite electrode 8 through the electrolytic liquid 28, returning to the power source 14. Thus, an anode reaction is performed on the metal web 1 on a part thereof opposed to the graphite electrode 8, while a cathode reaction occurs on the surface of the graphite electrode 8.

In this case, if the respective current magnitudes flowing through the graphite electrode 7 and the insoluble anode 20 are represented by $I_a$ and $\beta$, $\beta$ is controlled such that $\beta>0$. This can be attained by using thyristors and by controlling the gating time thereof, or by controlling a variable resistor or the like inserted in the electric circuit in the case where diodes are used instead of thyristors. Further, it is possible to effect such control by adjusting the distance between the anode electrode 20 and the metal web 1 or by varying the effective area of the anode electrode 20. Furthermore, an electrolytic liquid circulating tank for exclusive use of the auxiliary electrolytic cell 15 may be provided so that parameters of the electrolytic liquid, such as its temperature and density, may be controlled independently.

For the reverse current, the current $I_r$ flows from the power source 14 to the graphite electrode 8 and the insoluble anode 30 and then to the metal web 1 through the electrolytic liquid 28. In this case, if the values of the respective currents in the graphite electrode 8 and the insoluble anode 30 are represented by $I_c$ and $\alpha$, $\alpha$ is controlled such that $\alpha>0$. At this time, an anode reaction is performed on the graphite electrode 8, while a cathode reaction occurs on the surface of the metal web 1 adjacent the electrode 8. Further, the current $I_r$ flows through the metal web 1 and into the graphite electrode 7 through the electrolytic liquid 28, returning to the power source 14. Thus, a cathode reaction is effected on the surface of the graphite electrode 7, while an anode reaction occurs on the surface of the metal web 1 opposed to the electrode 7. During the reverse current time, the thyristor or diode 22 is reversed biased, and hence the current $I_r$ does not flow in the electrode 20.

According to the method of the present invention, neither of the graphite electrodes 7 and 8 is oxidized or consumed; that is, both graphite electrodes 7 and 8 are extremely stable. More specifically, in the case where the graphite electrode 7 acts as an anode, the current is expressed by $I_a=I_n-\beta$, while when it acts as a cathode, the current is expressed by $I_c=I_n$. Control is effected such that $I_n=I_r$ and $\beta>0$, and therefore $I_a<I_c$ is established for the graphite electrode 7. As to the graphite electrode 8, when it acts as an anode, the current is expressed by $I_a=I_r-\alpha$, while when it acts as a cathode, the current is expressed by $I_c=I_n$. Since control is effected such that $I_n=I_r$ and $\alpha>0$, the relation $I_a<I_c$ is established for the graphite electrode 8. Further, because insoluble materials are used for the auxiliarly electrodes 20 and 30 in the respective auxiliary electrolytic cells 15 and 25 and only an anode reaction is generated thereat, these electrodes are considerably stable.

Figure 4:
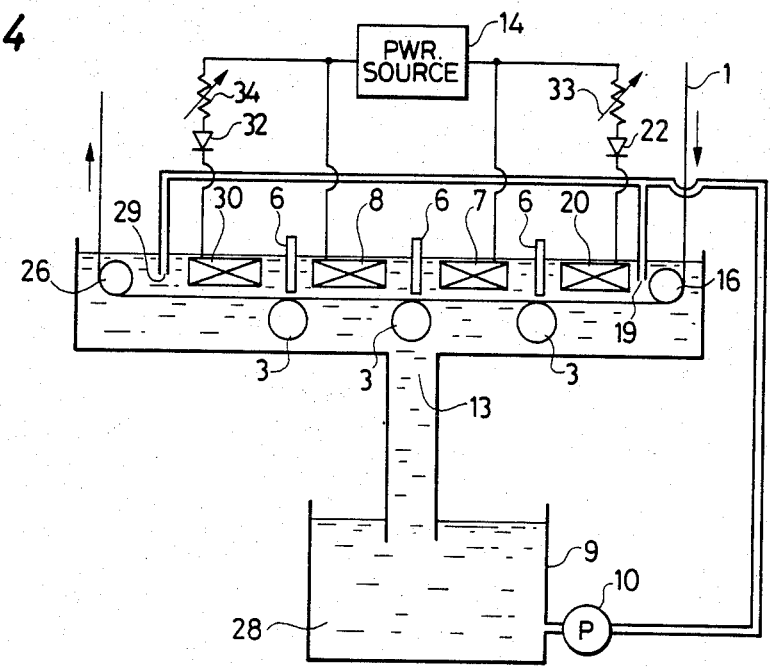

FIG. 4 shows another embodiment in which the electrolytic cell 4 is divided by three insulators 6 into four chambers with insoluble anodes 20 and 30 provided in the outer chambers. In this embodiment, the auxiliary electrolytic cells 15 and 25 are not used. Variable resistors 33 and 34 are provided in series with the respective diodes 22 and 32 to control the current flowing in the diodes 22 and 23.

Figure 5:
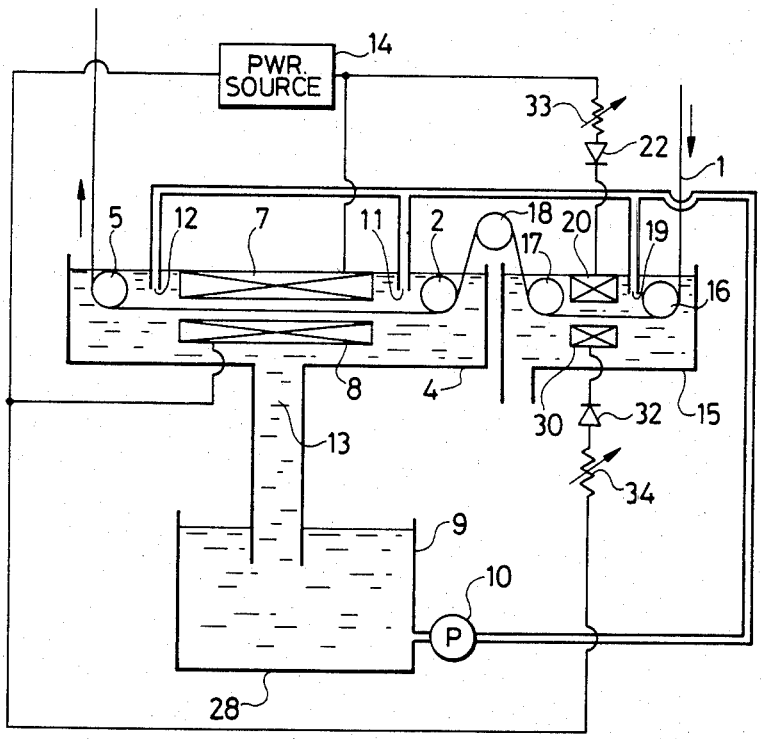

FIG. 5 shows a yet further embodiment in which both the surfaces of a metal web 1 are electrolytically processed simultaneously. Otherwise, the principles and mode of operation are the same as in the case of FIG. 3 above.

According to the present invention, for example, nitric acid, hydrochloric acid, sulfuric acid, or the like is utilized as the electrolytic liquid 28. As described above, the present invention is featured in that a symmetric alternating waveform current is used, a part of the current is distributed to auxiliary electrodes so as to control the current flow such that the graphite electrode stabilizing condition $I_a<I_c$ is established. The present invention is not restricted, however, by the form of the electrolytic cell, the number of chambers of the electrolytic cell, the order of arrangement of the electrodes, and the type of electrolytic liquid. Further, as to the alternating waveform current, the precise shape of the waveform is immaterial so long as it is a symmetric waveform current, that is, $I_n=I_r$.

Examples which clearly show the effects of the present invention will be described hereunder.

EXAMPLE 1

Using as an electrolyte a 1% aqueous solution of nitric acid at a temperature of 35° C., continuous electrolytic processing for roughening the surface of an aluminum plate intended for use as a support for an offset printing plate was performed employing an electrode arrangement as shown in FIG. 3 while applying a symmetric alternating waveform current of waveform (5) shown in FIG. 2. Graphite electrodes were employed, and platinum was utilized for the insoluble anode. After continuous electrolytic processing was performed for 20 hours under the condition that the forward current $I_n$=the reverse current value $I_r$=300 A at a processing speed of 1 m/minute, the surfaces of the graphite electrodes were visually inspected to check the amounts of consumption thereof. With respect to the currents $I_n$ and $I_r$ distributed to the graphite electrodes and the insoluble electrodes, respectively, the value of $\beta$ was varied by changing the effective lengths of the insoluble anodes. Also, the current's frequency was varied within a range of 30 to 90 Hz, but without noticeable difference. The conditions of consumption of the graphite electrodes were as presented in Table 1.

TABLE 1

| SAMPLE No. | $I_n$ (A) | $I_r$ (A) | $\alpha$ (A) | $\beta$ (A) | GRAPHITE ELECTRODE (7) | STATE OF CONSUMPTION | GRAPHITE ELECTRODE (8) | STATE OF CONSUMPTION |
|---|---|---|---|---|---|---|---|---|
| 1 | 300 | 300 | 0 | 0 | $I_a = I_c$ | Δ | $I_a = I_c$ | Δ |
| 2 | 300 | 300 | 30 | 30 | $I_a < I_c$ | | $I_a < I_c$ | |
| 3 | 300 | 300 | 60 | 60 | $I_a < I_c$ | | $I_a < I_c$ | |
| 4 | 300 | 300 | 90 | 90 | $I_a < I_c$ | | $I_a < I_c$ | |

: no consumption observable
Δ: some consumption observed

For Samples No. 2, 3 and 4, roughened surfaces superior as a support for an offset printing plate were obtained.

EXAMPLE 2

Using a 1% aqueous solution of hydrochloric acid at a temperature of 35° C., an experiment was effected under the same conditions as in Example 1. The same results as in the case of Table 1 were obtained.

EXAMPLE 3

In this Example, a 20% aqueous solution of sulfuric acid at a temperature of 30° C. was employed, and electrolytic processing for roughening the surface of an aluminum plate intended for use as a support for an offset printing plate was performed using an electrode arrangement as shown in FIG. 3 by applying a symmetric alternating waveform current of the type of waveform (2) shown in FIG. 2. Graphite electrodes were used, and lead was utilized for the insoluble anode. After continuous electrolytic processing was performed for 20 hours under the condition that the forward current value $I_n$=the reverse current value $I_r$=50 A at a processing speed of 1 m/minute, the surfaces of the graphite electrodes were visually observed to check the amounts of consumption thereof. With respect to the currents $I_n$ and $I_r$ distributed to the graphite electrodes and the insoluble electrodes, respectively, the value of $\beta$ was varied by changing the effective lengths of the insoluble anodes. Although, as before, the frequency was varied within a range of 30 to 90 Hz, no difference was noticed in the amounts of consumption. The results of this Example are presented in Table 2.

TABLE 2

| SAMPLE No. | $I_n$ (A) | $I_r$ (A) | $\alpha$ (A) | $\beta$ (A) | GRAPHITE ELECTRODE (7) | STATE OF CONSUMPTION | GRAPHITE ELECTRODE (8) | STATE OF CONSUMPTION |
|---|---|---|---|---|---|---|---|---|
| 5 | 50 | 50 | 0 | 0 | $I_a = I_c$ | Δ | $I_a = I_c$ | Δ |
| 6 | 50 | 50 | 10 | 10 | $I_a < I_c$ | | $I_a < I_c$ | |
| 7 | 50 | 50 | 20 | 20 | $I_a < I_c$ | | $I_a < I_c$ | |

: no observable consumption
Δ: some consumption observed

According to the present invention, as described above, the consumption rate of graphite electrodes is greatly reduced so that it becomes possible to attain continuous electrolytic processing with a high efficiency. Moreover, it is possible to expect derivative effects such as omission of maintenance and inspection, reduced costs, and the the like.

The present invention is not restricted to the described embodiments, and it can have wide applications.

We claim:

1. In a method for continuously electrolytically processing a metal web using graphite electodes and a symmetric alternating waveform current, the improvement wherein a part of a half cycle of said current is bypassed into at least one separately provided auxiliary anode through diode means so that the magnitude of a current contributing to a cathode reaction on surfaces of said graphite electrodes is larger than the magnitude of a current contributing to an anode reaction on said surfaces of said graphite electrodes.

2. The method of claim 1, wherein said separately provided anode is made of a nonreactive material.

3. The method of claim 1, wherein said at least one separately provided anode comprises first and second anodes provided in respective electrolytic cells arranged upstream and downstream of an electrolytic cell containing said graphite electrodes.

4. The method of claim 1, wherein said at least one separately provided auxiliary anode comprises first and second auxiliary anodes separated from said graphite electrodes by insulating barriers.

5. The method of claim 1, wherein said at least one auxiliary anode comprises first and second auxiliary anodes disposed in an electrolytic cell upstream from an electrolytic cell containing said graphite electrodes, said first and second auxiliary anodes being disposed on opposite sides of said metal web, and said graphite electrodes comprising first and second graphite electrodes disposed on opposite sides of said metal web.

6. The method of claim 1, wherein resistors are connected in series with said diode means.

* * * * *